United States Patent [19]

Gorling

[11] 3,984,229

[45] Oct. 5, 1976

[54] METHOD FOR PRODUCING COARSE POWDER, HARDENED IRON OXIDE MATERIAL FROM FINELY DIVIDED RAW MATERIAL SUBSTANTIALLY CONSISTING OF HEMATITE AND/OR MAGNETITE

[75] Inventor: Karl Goran Gorling, Lidingo, Sweden

[73] Assignee: Boliden Aktiebolag, Stockholm, Sweden

[22] Filed: July 22, 1974

[21] Appl. No.: 490,750

Related U.S. Application Data

[63] Continuation of Ser. No. 326,782, Jan. 26, 1973, abandoned, which is a continuation of Ser. No. 135,147, April 19, 1971, abandoned.

[30] Foreign Application Priority Data

Apr. 20, 1970 Sweden ..... 5392/70

[52] U.S. Cl. ..... 75/3; 75/9; 75/26

[51] Int. Cl.[2] ..... C22B 1/08; C22B 1/10

[58] Field of Search ..... 75/9, 26, 3

[56] References Cited

UNITED STATES PATENTS

| | | | |
|---|---|---|---|
| 3,094,409 | 6/1963 | Renzoni | 75/9 |
| 3,776,533 | 12/1973 | Vlnaty | 75/9 |

*Primary Examiner*—Peter D. Rosenberg
*Attorney, Agent, or Firm*—Stevens, Davis, Miller & Mosher

[57] ABSTRACT

A method for agglomerating finely divided iron oxide material, substantially consisting of hematite and/or magnetite, preferably enriched iron ore concentrates, and hardening the agglomerates thus formed. The fine material is agglomerated by rolling, micropelletizing or other granulating methods to a particle size distribution convenient fluidizing purposes, whereafter the material is transferred to a fluidized bed furnace in which the bed is heated by introducing gaseous or liquid fuel and gas containing free oxygen or by hot gases. The major portion of the material is then removed from the bed in an agglomerated and hardened condition.

7 Claims, 5 Drawing Figures

Figure 1:
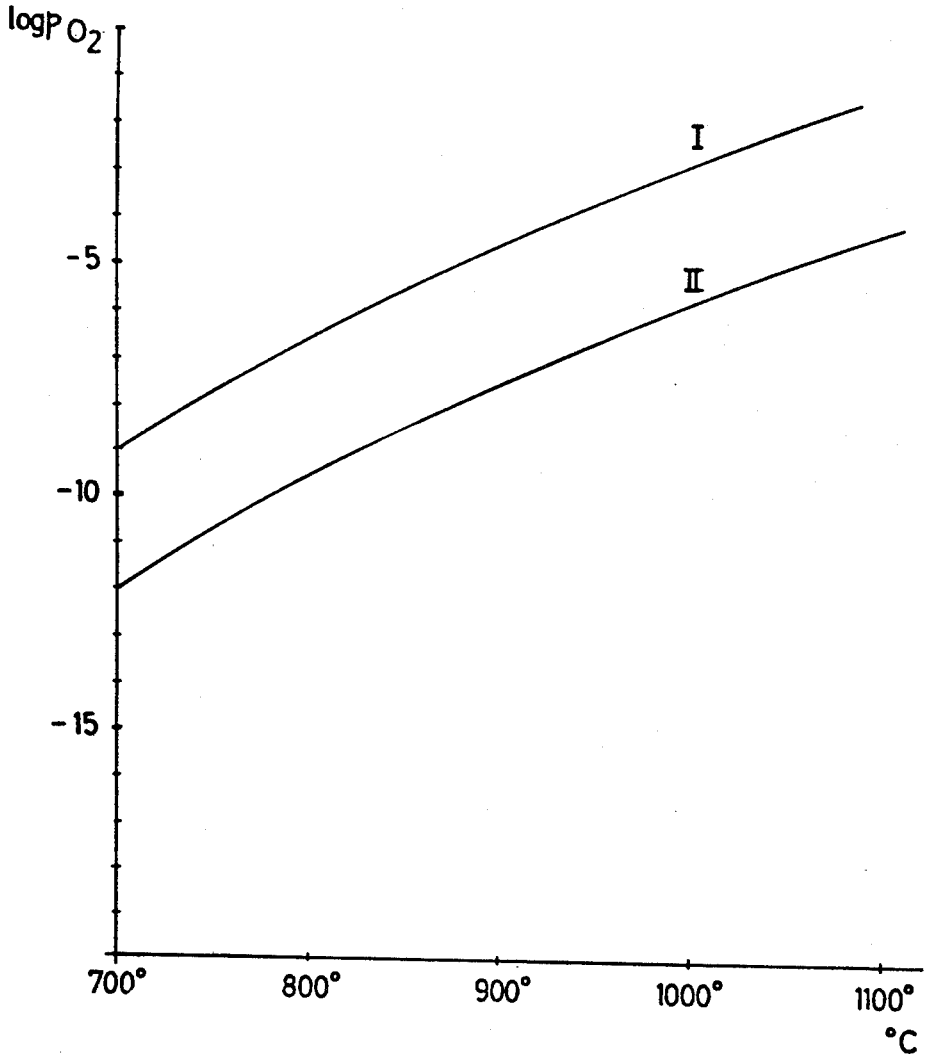

METHOD FOR PRODUCING COARSE POWDER, HARDENED IRON OXIDE MATERIAL FROM FINELY DIVIDED RAW MATERIAL SUBSTANTIALLY CONSISTING OF HEMATITE AND/OR MAGNETITE

This is a continuation of application Ser. No. 326,782, filed Jan. 26, 1973 now abandoned (which is a continuation of 135,147 filed Apr. 19, 1971 now abandoned.

The present invention relates to a method for producing coarse powder iron oxide material from finely divided raw material substantially consisting of hematite and/or magnetite, the material being agglomerated by rolling, micropelletizing or some other granulating method to a particle size distribution at which the material is suitable for subsequent thermal treatment in fluidized beds, in which the formed agglomerates are hardened. Any remaining fines are separated from the agglomerates during the hardening process by windsifting and are entrained with the gas departing from the fluidized bed reactor and can be separated from the gas and returned to the agglomerating stage.

Certain raw materials which are to undergo metallurgical treatment possess unsatisfactory physical properties. These materials are often in fine powder form and have a low degree of denseness and as a result thereof are highly dust forming. Moreover, such materials are liable to absorb water when moistened. Such properties render the material less suitable for handling, storage, transportation and further metallurgical treatment, such as pan sintering or sintering in conveyortype furnaces, or treatment in rotary furnaces, shaft furnaces or electric smelting furnaces. These materials are also often too fine for use with fluidizing processes, in which large quantities of gaseous fluidizing medium are charged to the system.

A particularly serious and difficult problem is one concerned with the handling, storing, transporting and processing of materials obtained from the roasting of fine metal sulphides, particularly flotation concentrates, which concentrates are finely ground before being enriched, in order to facilitate selective isolation of the different minerals contained therein. Similar problems exist when treating roasted products derived from coarser sulphide materials which have been decrepitated during the roasting process.

THE PRIOR ART

Various methods have been proposed and tested for producing coarse powder, roasted products from finely divided materials to render those materials suitable for charging to blast furnaces, of which methods pelletizing and briquetting can be mentioned in particular. These methods involve firstly agglomerating the material in the absence of heat and in the presence of water and possibly also a binding composition, whereafter the material is normally dried and burned at elevated temperatures. Attempts have also been made to briquette iron oxide raw materials at elevated temperatures (800° – 1100°C). These experiments, however, have not lead to processes which can be used industrially, not only because it is both technically difficult and expensive to heat extremely fine material but also because it has been impossible to find a sufficiently strong material for the briquette molds.

GENERAL DESCRIPTION OF THE INVENTION

The present invention relates to a method for agglomerating finely divided iron oxide material consisting mainly of hematite and/or magnetite, preferably enriched iron ore concentrates, and hardening the formed agglomerates, and is characterized in that the finely divided material is agglomerated by rolling, micropelletizing or some other granulating method and given a particle size distribution suitable for fluidizing purposes, whereafter the material is transferred to a fluidized bed furnace in which the bed is heated by supplying thereto a gaseous or liquid fuel and gas containing free oxygen or hot gases, wherein substantially all the material is removed from the bed in an agglomerated and hardened condition. A minor quantity of fines which are entrained with the roaster gases may suitably be separated therefrom and returned to the agglomerating stage.

As previously mentioned, the fine powder iron oxide material can be agglomerated in a number of different ways. A number of such methods which can be used in connection with the method of the present invention are described in the Swedish Patent No. 304,767, the Belgian Patent No. 40,320 and the Spanish Patent No. 340,602. According to Swedish Patent No. 304,767 finely divided iron bearing material to undergo metallurgical treatment is agglomerated at elevated temperatures by rolling the material between substantially smooth or surface knurled rolls at a temperature of between 300° and 600°C, whereafter the formed cakes are crushed. The Spanish Patent No. 340,602 describes a method for agglomerating finely divided iron oxide material obtained from the roasting of iron sulphides which shall be used for further metallurgical treatment by suction sintering, smelt reduction (Dored) or in the manufacture of sponge iron and chlorinating roasting processes, hot roasted products being compressed between rolls provided with brickette molds at a temperature of between 200° and 430°C, whereafter the formed brickettes are optionally chrushed into smaller pieces. Further, the Belgian Patent No. 740,320 describes a method for agglomerating iron oxide material, preferably magnetite, according to which the material is agglomerated while cold or while heated to a temperature of 100°C between substantially smoothed or surface knurled rolls in the presence of a lubricant, which is added in such quantities that the friction between the particles of material is considerably reduced and at most in quantities which can be vaporized by the heat developed by said friction.

The last mentioned method has been found particularly suitable for use when agglomerating in accordance with the present invention.

The material is therefore suitably agglomerated between smooth or surface knurled rolls at a roll pressure of 1–10 tons per centimeter roll length, the roll pressure being selected with respect to the diameter of the rolls used and the properties of the material.

As previously mentioned, in accordance with the invention hardening of the material is effected in a fluidized bed, which is heated to the requisite temperature by burning gaseous or liquid fuel, such as natural gas, generator gas or oil. The temperature to which the agglomerate is to be hardened depends on the properties of the iron oxide material and the requirements placed on the mechanical strength of the end product, and on the desired temperature of the exiting, hardened agglomerates. The hardening process can normally be effected within the temperature range of 500°–1100°C.

Supply and combustion of the gaseous or liquid fuel can be effected in a number of different ways. When using liquid fuel, it has been found suitable to charge the necessary free oxygen containing gas, e.g. air, through the furnace grate, the gas serving as a fluidizing medium. In accordance with a preferred embodiment, the oil is introduced through nozzles which are arranged in the bed in a manner to obtain a uniform distribution. The oil may also be charged to the bed together with the oxygen-containing gas in a vaporized or suspended form. When using gaseous fuel, the gas may be in the form of a natural gas or gas generated from solid or liquid fuel. The gas may optionally be charged through the grate or introduced directly into the bed. If the fluidized bed is heated with hot gases, these may comprise fluid gases obtained by burning suitable fuel externally of the fluidized bed furnace. The hot gases may, alternatively, be heated indirectly and may comprise, for example, hot air. From the point of view of heat economy it is thus suitable to recover the heat from the hot waste gases eminating from the fluidized bed furnace by using this heat to pre-heat the air of combustion, for example in a conventional heat exchanger. If there is a local need of steam, cooling of the waste gas may suitably be effected conventionally in a waste heat boiler.

The hardened coarse powder material leaving the bed may be transferred in a hot condition to further treatment stages, for example for reduction to sponge iron. Agglomerates obtained in accordance with the invention have also been found suited for chlorinating volatilization processes, e.g. such as those described in Swedish Patent No. 319,785 (Patent Application 3845/66) or the East German Patent No. 70,609. According to these patents oxidic iron material containing one or more of the substances Cu, Zn, Pb, Co, Ni, Au, Ag, As, Bi, Sb and S is treated in a hot condition, for example at temperatures of between 600° and 1100°C, with a gas containing chlorine or chlorine compounds or with a material which generates a gas containing chlorine or chlorine compounds, whereby the said substances are volatilized. The chlorinating process may be effected in different types of furnaces. Fluidized bed furnaces or moving bed furnaces have been found particularly suitable.

If the hardened products is to be cooled, this can be effected in a number of different ways, for example in a fluidized bed reactor in which cooling is either effected indirectly with cooling elements and a cooling medium, comprising air or water, or directly, by introducing air through the grate. The air thus heated can be used for burning fuel necessary to the process. In another cooling method, the physical heat of the agglomerates is used to dry concentrates which are to be agglomerated. In this instance, the wet concentrates are charged to the bed, wind-sifted therein and separated in a cyclone located behind the cooling reactor and then passed to the agglomerating stage. In order to improve the heat economy of the system still further, the agglomerates can be heated to hardening temperature in two or more stages. A number of alternative cooling methods are described in the following.

Even though it is generally preferred to agglomerate the material by rolling, any agglomerating method which produces an agglomerate of suitable particle size distribution can be used. If so desired, a binding agent can be added during the agglomerating process, for example such as bentonite or the like. Additions of finely divided sponge iron have been found to give a particularly strong agglomerate. Naturally, such iron material as, for example, carbonates and hydrates may also be calcined in the process.

As previously mentioned, when hardening the iron oxide agglomerates, the material is wind-sifted, whereby the the particles are entrained with the exiting gases. These fine particles are separated in a gas purification plant, returned to the process and mixed with the incoming fine raw material. It is therefore to advantage to charge the separated material in a hot condition, so as to heat and dry the incoming raw material to a certain extent.

As previously mentioned, the particle size of the agglomerates should be adjusted for fluidization purposes, and should not generally exceed approximately 8 mm.

The present method provides a non-dusty, agglomerated and hardened iron oxide material which can be transported in a substantially dry condition without giving rise to dust problems. Because of its coarse structure, the material is well suited for suction sintering or further treatment in different types of furnaces. The material is naturally suited for continued treatment in a fluidized bed furnace. A further advantage is that the material can be removed from the furnace in a hot condition and subjected directly to further treatment in other thermal processes, for example chlorinating volatilization. In this latter instance, the material is cooled after the further treatment is completed.

When the finely divided iron oxide material to be treated in accordance with the invention is hematite, it can be converted to magnetite in connection with the agglomerate hardening stage. This is achieved by adjusting the relationship between fuel and oxygen supplied to the system in a manner whereby the partial pressure of oxygen in the resulting gases is maintained beneath a pressure temperature curve (II, FIG. 1), which in a coordinate system where the partial pressure of oxygen in atmospheres is expressed as $\log_{10}P_{O_2}$ as the ordinate and the temperature in °C as abscissa, is drawn through the following points:

| $\log_{10}PO_2$ | Temp. |
|---|---|
| −12.0 | 700 |
| − 9.5 | 800 |
| − 7.5 | 900 |
| − 5.8 | 1000 |
| − 5.0 | 1050 |

It is known from a number of magnetizing roasting processes in which hematitic material is treated so that it can be magnetically enriched to adjust the relationship between fuel and oxygen for this purpose. Thus, it is possible through the method of the invention to convert a fine hematitic material into a coarse powder hardened magnetitic material. It has been discovered that a stronger agglomerate can be obtained from magnetite than from hematite.

It is also possible to enrich magnetically fine hematitic material in conjunction with the agglomerating process, the method in this instance being suitably carried out in a slightly modified manner. Thus, the fine material can be charged to the hardening furnace without first being agglomerated and the ratio of fuel to oxygen adjusted in the aforegiven manner, so that magnetite is obtained. All the fine material charged to the furnace is entrained with the roaster gases and passed to a magnetic separator subsequent to being suitably cooled and separated from the gases. Non-magnetic material can be separated in this way, and the magnetic material is passed on to the aforementioned agglomerating means, from which the material is then returned to the hardening reactor. The material is then hardened in the reactor under continued magnetizing conditions, whereafter it is removed as magnetite from the bed of the hardening reactor in an agglomerated hardened form.

It is also possible when applying the method of the present invention to isolate such substances present in the fine raw material as arsenic, antimony, bismuth, tin and lead. In this case, it has been discovered that the partial pressure of oxygen should be adjusted beneath a pressure temperature curve (I in FIG. 1) passing through the following points:

| $\log_{10}PO_2$ | Temp. |
|---|---|
| −9.0 | 700 |
| −6.5 | 800 |
| −4.5 | 900 |
| −3.0 | 1000 |
| −2.3 | 1050 |

SPECIAL DESCRIPTION

The invention will now be described in more detail with reference to the accompanying FIGS. 2–5, which illustrate different embodiments of the invention.

Figure 2:
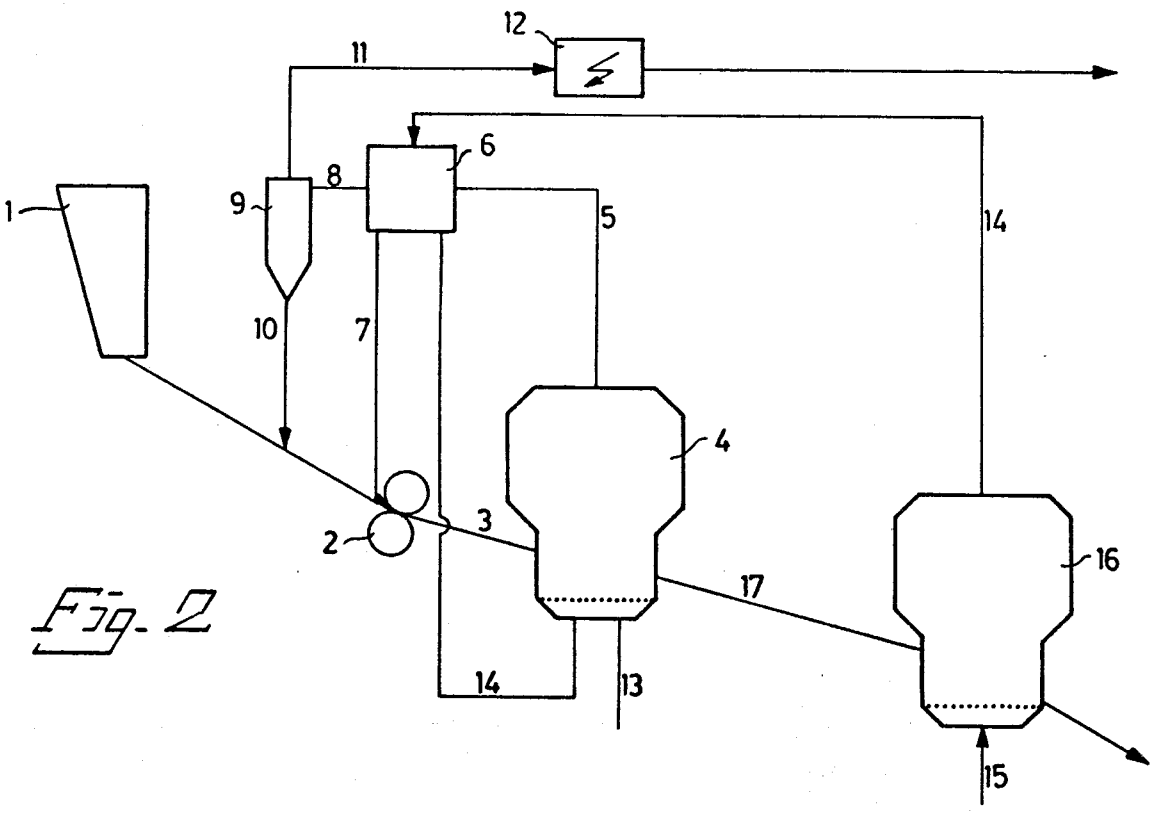

In FIG. 2 there is shown a raw material container 1 for fine iron oxide material. The material is passed from the container to an agglomerating means 2, which comprises two substantially smooth or surface knurled rolls, between which the material is compressed to form an agglomerate having a particle size distribution suitable for fluidizing purposes. The agglomerated iron oxide is passed, via a line 3, to a fluidized bed furnace, in which the agglomerates are heated and hardened at a temperature of 800°–900°C. Gas and entrained dust leaving the furnace 4 are passed via a line 5, to a heat exchanger 6, in which the gas is cooled. Dust falling from the gas in the heat exchanger 6 is passed to the agglomerating means 2 via a line 7, while the cooled gas is passed to a cyclone 9 via a line 8. Dust separated in the cyclone is returned to the agglomerating stage via a line 10, while the purified gas is removed via a line 11 and an electrofilter 12. The residual heat of the gas can be utilized, for example, for drying incoming raw materials in a manner not shown.

The furnace 4 is supplied with heat through the medium of liquid or gaseous fuel, which is charged to the furnace via a line 13, either directly through the bed or through the grate. Air for fluidizing and combusting the aforementioned fuel is supplied pre-heated via a line 14, after having first passed a cooling reactor 16 and a heat exchanger 6 via a line 15. The hardened agglomerates are removed from the furnace 4 through a line 17 and passed to a cooling reactor 16, where they are cooled by air supplied through the line 15 and simultaneously fluidized.

Figure 3:
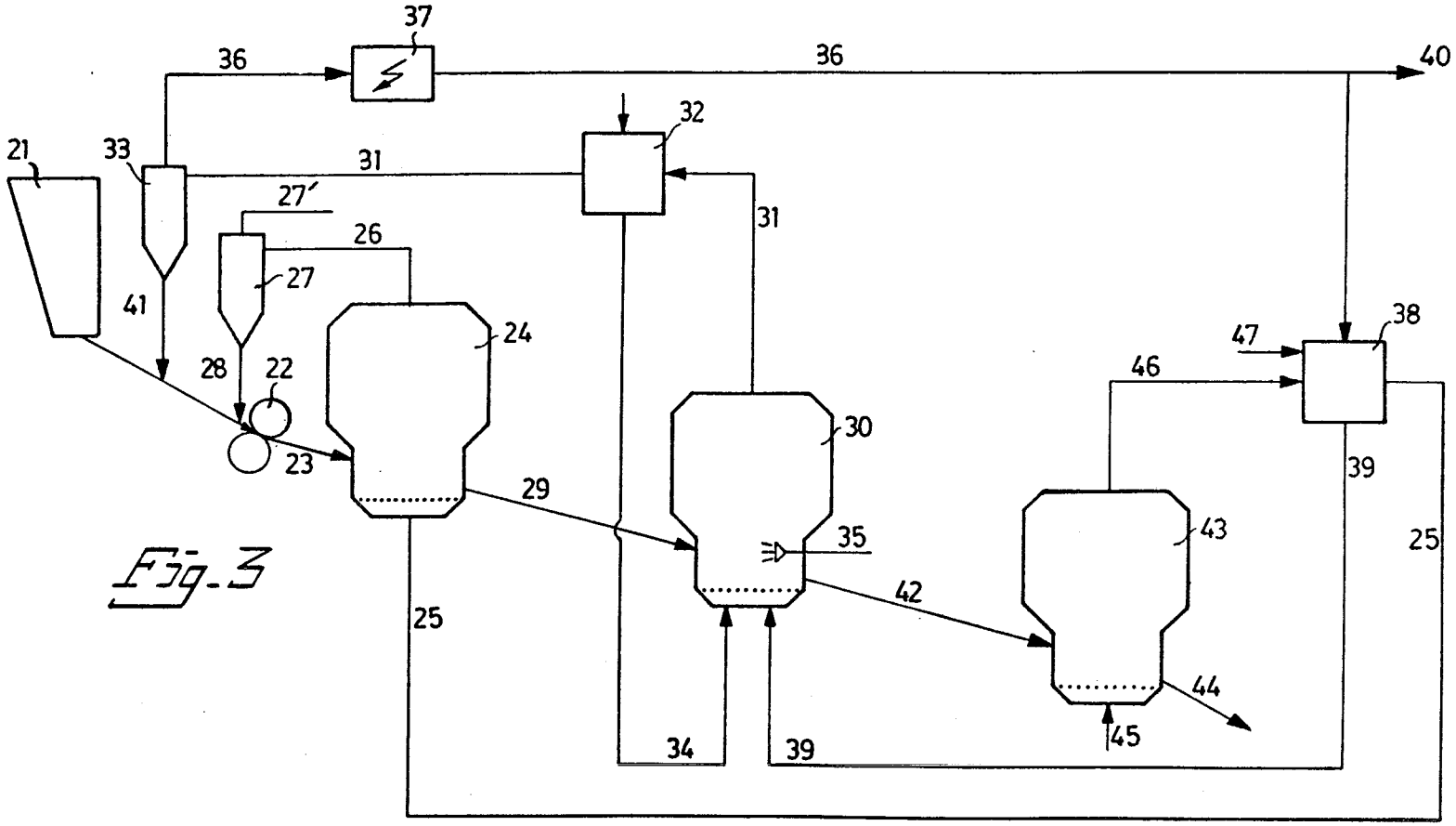

FIG. 3 illustrates an embodiment in which heating and hardening are effected in two stages. The reference numeral 21 in the Figure illustrates a raw material container, from which material is passed to an agglomerating means 22 consisting of two substantially smooth or surface knurled rolls, between which the material is compressed to form agglomerates having a particle size distribution suitable for fluidizing purposes. The agglomerated iron oxide is passed, via a line 23, to a pre-heat reactor 24, in which the agglomerates are heated to a temperature of roughly 400°C. A hot gaseous medium is passed to the pre-heat reactor 24, via a line 25, for heating and fluidizing the agglomerated iron oxide. The gas and fine particles entrained therewith are passed from the pre-heating reactor 24, via a line 26, to a cyclone 27, in which the fine material is separated and returned to the agglomerating stage via a line 28. The gas leaving the cyclone 27 via a line 27′ is used suitably for drying the fine raw material. The pre-heated agglomerated iron oxide is passed from the pre-heat reactor 24, via a line 29, to a hardening reactor 30. The agglomerates are fluidized in the reactor 30 while being heated to roughly 800°–900°C. Gas leaving the reactor 30 and containing entrained fines is passed to a cyclone 33 via a line 31 and a heat exchanger 32. Air is pre-heated in the heat exchanger 32 and is passed via a line 34 to the reactor 30 for combusting fuel passed through burners 35. The waste gas, which has been purified from the major portion of entrained goods in the cyclone 33, is passed via a line 36 and an optional electrofilter 37 to a heat exchanger 38. Subsequent to being heated in the heat exchanger 38, the gas is passed back to the reactor 30 via a line 39. Surplus gas is taken out over a line 40. The solid material separated in the cyclone 33 is passed, via a line 41, to the agglomerating means 22, where it is agglomerated together with the incoming raw material and the material returned from the cyclone 27. The agglomerated material is passed from the hardening reactor 30 over a line 42 to a cooling reactor 43, in which the agglomerates are cooled while being fluidized with air to approximately 300°C and are discharged via a line 44 as a coarse powder end product which can be used in further metallurgical processes. The requisite quantity of air is supplied to the cooling reactor 43 through a line 44. The air is removed from the cooling reactor via a line 46, and is passed to the heat exchanger 38 as combustion air for fuel introduced via a line 47. The gases of combustion are passed to the pre-heat reactor 24 via the line 25.

Figure 4:
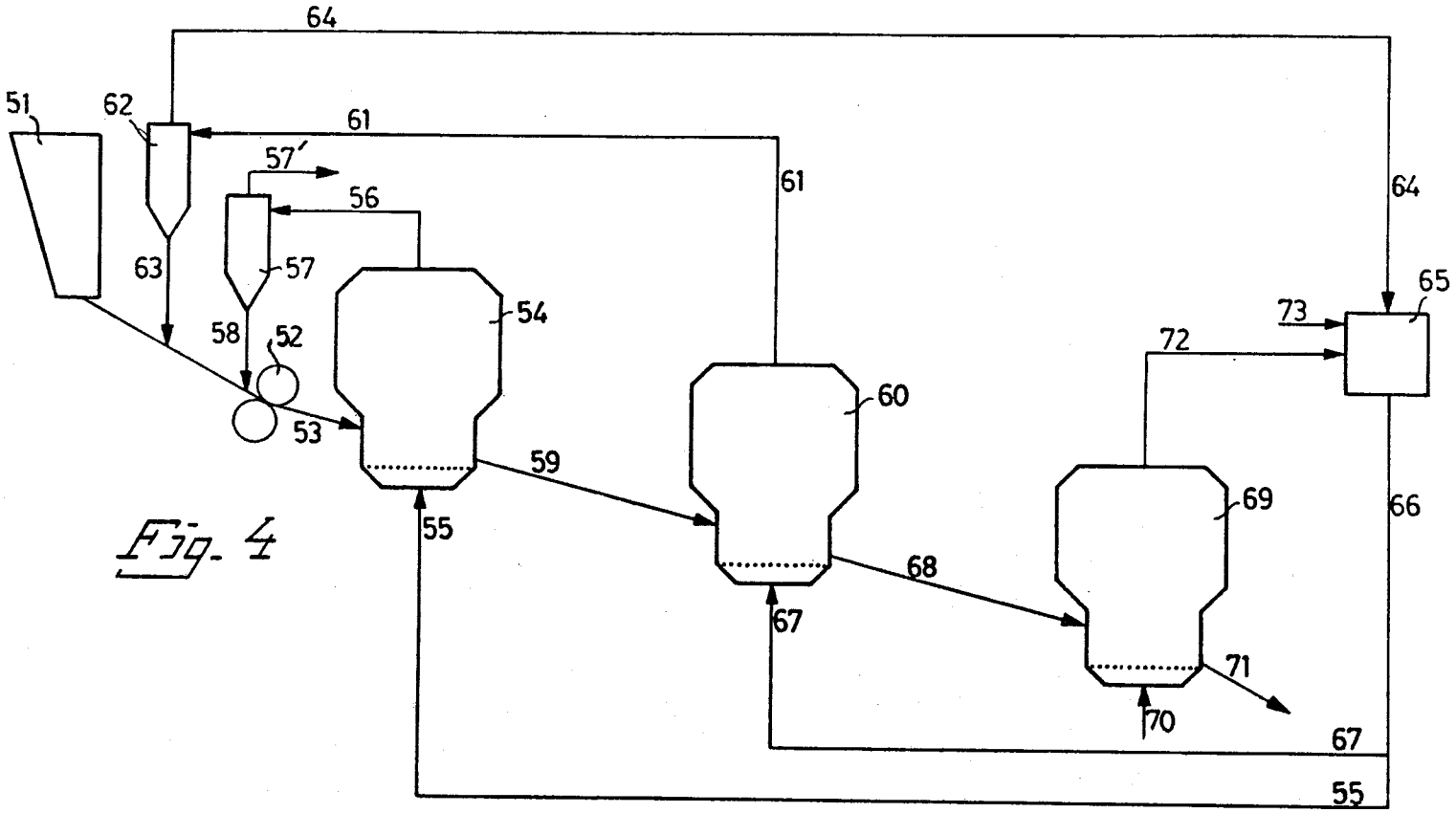

FIG. 4 illustrates a variant of the two-stage hardening process illustrated in FIG. 3, in which hardening heat is exclusively supplied by means of circulating gas heated externally of the reactors. Raw material is passed from a container 51 to an agglomerating means 52. The agglomerates are passed, via a line 53, to a pre-heat reactor 54. The reactor 54 is fed with hot gas via a line 55, for heating and fluidizing the agglomerates at a temperature of roughly 400°C. Gas and dust entrained therewith departing from the reactor 54 are passed to a cyclone 57, via a line 56. Dust separated in the cyclone 57 is returned to the agglomerating means 52 via a line 58. The purified gas is removed from the cyclone 57 via a line 57′, and can be used for drying the raw material. The pre-heated agglomerates are passed, via a line 59, to a hardening reactor 60, in which they are hardened at a temperature of 800° to 900°C while being fluidized. The exiting gas is passed to a cyclone 62 via a line 61. Dust separated in the cyclone is returned via a line 63 to the agglomerating stage. Purified gas departing from the cyclone is passed, via a line 64, to a combustion chamber 65, from which the gas, subsequent to being heated, departs through a line 66. The gas is then divided into two streams, one of which is passed through the line 55 to the pre-heat reactor 54 and the other through a line 67 to the hardening reactor 60 and comprises the fluidizing medium therein. The gas contains the heat necessary for the hardening process. The hardened agglomerates are removed through the line 68 and passed to a cooling reactor 69, in which they are cooled with air while being fluidized, the air being introduced at 70. The cooled, hardened agglomerates are discharged through a line 71. Air exiting from the cooling reactor is passed through a line 72 to the aforementioned combustion chamber 65, where it constitutes a combustion air for liquid or gaseous fuel supplied via a line 73.

Figure 5:
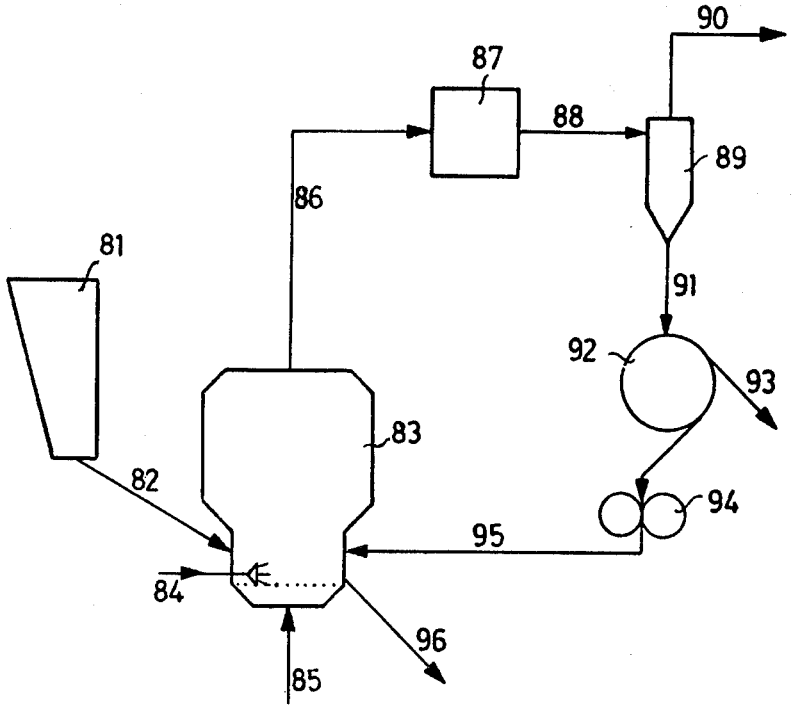

FIG. 5 illustrates how the method of the present invention can be used when magnetically enriching material which was initially hematitic in connection with agglomerating and hardening processes. The Figure illustrates a container 81 for finely divided hematitic raw material, which is passed, via a line 82, to the bed of a fluidized bed furnace 83, in which the material is heated under the previously mentioned magnetite forming conditions. Oxygen for combusting oil introduced at 84 is supplied, via a line 85, in the form of air, which also serves as a fluidizing medium. The finely divided material, in which the iron oxide are practically completely comprised of magnetite, is removed from the furnace 83 together with the waste gases via a line 86 and passed to a heat exchanger 87. The gases and dust are passed in a cold condition from the heat exchanger 87 via a line 88 to a cyclone 89, in which the entrained magnetitic material is separated. The purified gas is removed from the cyclone via a line 90. The separated solid material is passed from the cyclone 89, via a line 91, to a magnetic separator 92, from which non-magnetic material is removed via a line 93 and magnetic material is passed to an agglomerating means 94. The agglomerated magnetite is returned to the furnace 83 via a line 95. The hardened, coarse agglomerates are then removed from the bed of the furnace 83 via a line 96 and are optionally passed to a cooling reactor (not shown). The method described with reference to FIG. 5 can be conducted in several stages and heat can be recovered in principally the same manner as that disclosed in the previous embodiments. As previously mentioned, the fluidizing bed in the furnace 83 may be heated by means of hot gases instead of by burning oil therein.

What we claim is:

1. A method for the production of a hardened agglomerated product from fine grained iron oxide bearing materials comprising a. agglomerating said fine grained iron oxide bearing material to a size distribution suited for fluidizing treatment;

b. passing the agglomerated material to a fluidized bed furnace to be fluidized and heated;

c. passing to the furnace a medium to effect fluidizing and heating of the bed to maintain the temperature in the bed within the range of 500° – 1100°C; said medium selected from the group consisting of hot gases or a non-solid fuel and a gas containing free oxygen;

d. wind-sifting said material and entraining fine material from the bed with the roaster gases exiting the fluidized bed furnace and subsequently separating said fine material from said gases and e. removing hardened agglomerated iron oxide from the bed.

2. The method of claim 1 wherein said iron oxide bearing material is hematite.

3. The method of claim 1 wherein said iron oxide bearing material is magnetite.

4. A method according to claim 1, wherein the separated fine material is returned to the agglomerating stage.

5. A method according to claim 1, characterized in that fine material containing hematite is charged to the fluidized bed furnace, in which it is heated in an atmosphere of such oxygen partial pressure that the hematite is converted to magnetite, whereafter the material is removed in a finely divided state from the fluidized bed reactor with the exiting gases, is separated therefrom, magnetically enriched, agglomerated and returned to the fluidized bed furnace, from which it is removed from the bed in an agglomerated, hardened and magnetic form.

6. A method according to claim 1, in which the finely divided iron oxide material contains at least one of the substances As, Sb, Bi, Sn or Pb, characterized in that the agglomerated material is heated in the fluidized bed furnace in an atmosphere of such oxygen partial pressure that said substance or substances is or are driven off.

7. A method according to claim 1, characterized in that prior to the agglomeration stage the material is supplied with a binding agent, suitably comprising bentonite or the like.

* * * * *